US005985094A

United States Patent [19]

Mosca

[11] Patent Number: 5,985,094

[45] Date of Patent: Nov. 16, 1999

[54] SEMICONDUCTOR WAFER CARRIER

[75] Inventor: Joseph Mosca, Phoenix, Ariz.

[73] Assignee: Speedfam-IPEC Corporation, Chandler, Ariz.

[21] Appl. No.: 09/076,397

[22] Filed: May 12, 1998

[51] Int. Cl.[6] ..... B24B 37/00

[52] U.S. Cl. ..... 156/345; 451/287; 451/288

[58] Field of Search ..... 156/345; 204/297 R, 204/297 M; 118/730; 414/217, 222; 451/170, 272, 287, 288

[56] References Cited

U.S. PATENT DOCUMENTS

| | | | |
|---|---|---|---|
| 3,595,555 | 7/1971 | Cameron | 269/20 |
| 3,731,435 | 5/1973 | Boettcher et al. | 51/129 |
| 3,977,130 | 8/1976 | Degner | 51/131 |
| 4,193,226 | 3/1980 | Gill, Jr. et al. | 51/124 |
| 4,194,324 | 3/1980 | Bonora et al. | 51/131.5 |
| 4,270,314 | 6/1981 | Cesna | 51/131.4 |
| 4,313,284 | 2/1982 | Walsh | 51/131.4 |
| 4,466,852 | 8/1984 | Beltz et al. | 156/344 |
| 4,897,966 | 2/1990 | Takahashi | 51/131.3 |
| 4,918,869 | 4/1990 | Kitta | 51/131.1 |
| 4,918,870 | 4/1990 | Torbert et al. | 51/131.3 |
| 5,081,795 | 1/1992 | Tanaka et al. | 51/131.1 |
| 5,193,316 | 3/1993 | Olmstead | 51/281 |
| 5,205,082 | 4/1993 | Shendon et al. | 51/283 R |
| 5,230,184 | 7/1993 | Bukhman | 51/283 R |
| 5,267,418 | 12/1993 | Currie et al. | 51/216 R |
| 5,310,104 | 5/1994 | Zaidel et al. | 225/2 |
| 5,423,558 | 6/1995 | Koeth et al. | 279/3 |
| 5,423,716 | 6/1995 | Strasbaugh | 451/388 |
| 5,441,444 | 8/1995 | Nakajima | 451/289 |
| 5,443,416 | 8/1995 | Volodarsky et al. | 451/388 |
| 5,449,316 | 9/1995 | Strasbaugh | 451/289 |
| 5,472,374 | 12/1995 | Yamada | 451/303 |
| 5,476,414 | 12/1995 | Hirose et al. | 451/288 |
| 5,527,209 | 6/1996 | Volodarsky et al. | 451/388 |
| 5,571,044 | 11/1996 | Bolandi et al. | 451/385 |
| 5,582,534 | 12/1996 | Shendon et al. | 451/41 |
| 5,582,540 | 12/1996 | Su et al. | 451/259 |
| 5,584,746 | 12/1996 | Tanaka et al. | 451/41 |
| 5,584,751 | 12/1996 | Kobayashi et al. | 451/288 |
| 5,588,902 | 12/1996 | Tominaga et al. | 451/288 |
| 5,602,058 | 2/1997 | Ooizimi et al. | 437/209 |
| 5,605,488 | 2/1997 | Ohashi et al. | 451/7 |
| 5,643,053 | 7/1997 | Shendon | 451/28 |
| 5,651,724 | 7/1997 | Kimura et al. | 451/41 |
| 5,670,011 | 9/1997 | Togawa et al. | 156/345 |
| 5,679,065 | 10/1997 | Henderson | 451/290 |
| 5,681,215 | 10/1997 | Sherwood et al. | 451/388 |
| 5,720,849 | 2/1998 | Yokosuka et al. | 156/571 |

FOREIGN PATENT DOCUMENTS

| | | |
|---|---|---|
| 0 674 341 A1 | 9/1995 | European Pat. Off. . |
| 0 737 546 A2 | 10/1996 | European Pat. Off. . |
| 0 747 167 A2 | 12/1996 | European Pat. Off. . |
| 0 747 167 A3 | 1/1997 | European Pat. Off. . |
| 0 786 310 A1 | 7/1997 | European Pat. Off. . |
| 0 790 100 A1 | 8/1997 | European Pat. Off. . |
| 0 791 431 A1 | 8/1997 | European Pat. Off. . |
| 743850 | 6/1980 | Russian Federation . |

*Primary Examiner*—Bruce Breneman
*Assistant Examiner*—Alva C Powell
*Attorney, Agent, or Firm*—Fitch, Even, Tabin & Flannery

[57] ABSTRACT

The carrier assembly includes an internal pressurized fluid circuit which places an incompressible fluid layer between a pressure plate and an internal diaphragm. The internal diaphragm has a flexible portion providing gimbal action for the carrier assembly. The diaphragm and hydrostatic forces of the internal fluid circuitry combine to form a gimbal action exhibiting low friction, but which is otherwise rigid in other axes.

33 Claims, 5 Drawing Sheets

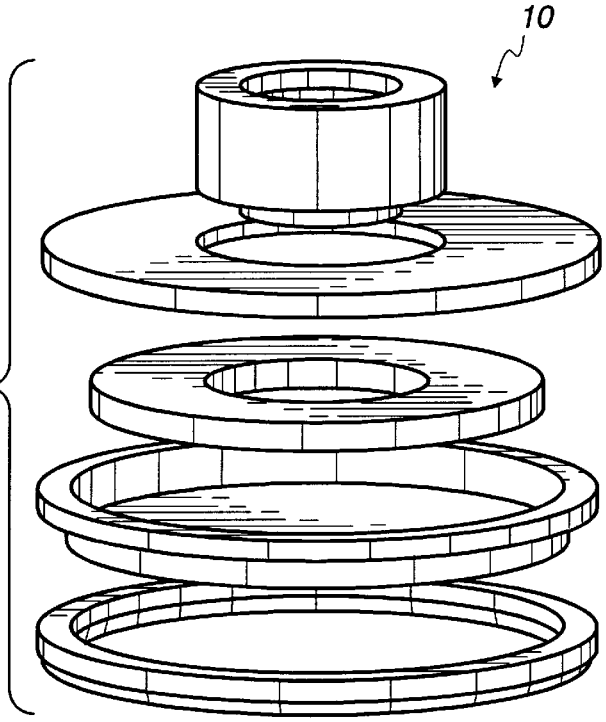
Fig. 4
Fig. 5
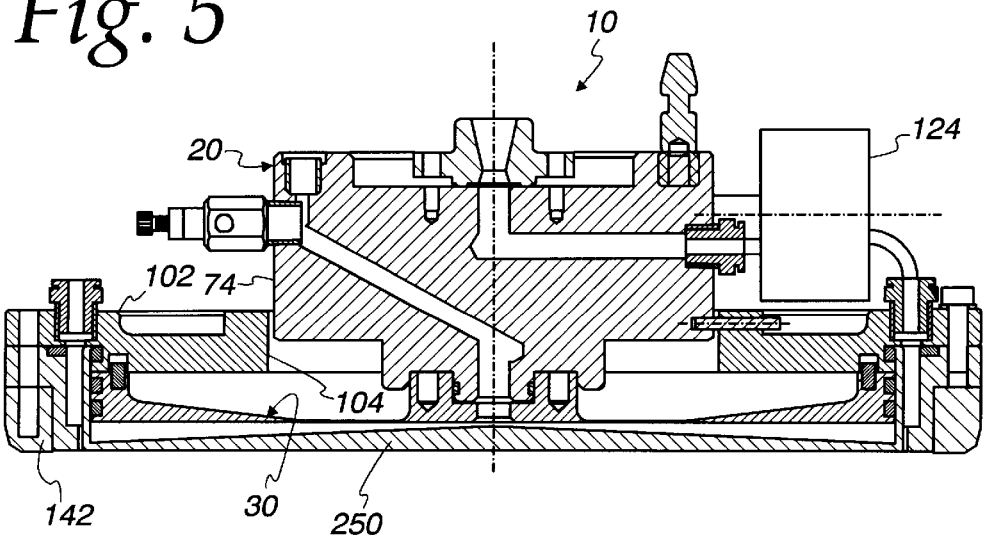

SEMICONDUCTOR WAFER CARRIER

BACKGROUND OF THE INVENTION

1. Field of the Invention

The present invention pertains to apparatus for polishing relatively thin workpieces and, in particular, to the chemical/mechanical polishing of semiconductor wafers.

2. Description of the Related Art

In the fabrication of semiconductor devices, the devices are typically mass produced by stacking layers of device structures on the surface of a semiconductor wafer. With the addition of each layer, the wafer must undergo surface treatment using chemical/mechanical polishing (CMP) or other processes in preparation for fabrication of the next wafer layer. A wafer carrier is used to acquire and provide backing support for the wafer as the wafer surface is pressed against a polish pad or other working surface, such as a linear belt.

Typically, surface treatment operations are concerned with restoring or maintaining wafer flatness, and many advantages have been a achieved in meeting these objectives. However, further advantages are continually being sought. For example, it is important that the wafer carrier be able to take on various angular positions with respect to the plane of the wafer surface being treated. Accordingly, wafer carriers are provided with some form of gimbal mechanism which typically includes a number of cooperating mechanical components. However, such mechanical gimbal arrangements typically vary somewhat in their freedom of movement from one angular position on the wafer carrier to another. Further, mechanical gimbal arrangements are susceptible to corrosion and contamination, requiring the wafer carrier to be disassembled for repair and replacement of deteriorated components.

During semiconductor wafer polishing, a downforce and reciprocating motion is typically applied to the wafer carrier, and these applied forces may alter the freedom of movement of the gimbal action. Over the life of the wafer carrier, the mechanical gimbal components are susceptible to ongoing wear, which, in precision wafer polishing, can interfere with desired precision polishing results. Further, because of the mechanical hysteresis inherent in mechanical gimbal actions, the effects exhibited on polished wafers can vary so as to complicate diagnostic or trouble shooting efforts.

Restrictions in the freedom of movement of the gimbal action may influence the uniformity of a planarized wafer surface. With ongoing industry demands to increase circuit density, continual improvements in gimbal action are being sought. Wafer carriers must meet certain practical demands, one of which is their ability to produce a highly planar surface that is uniform across usable portions of the wafer being treated. Increasingly, wafer carriers and other components of wafer surface treatment processes are being called upon to produce highly planar surfaces across the substantial entirety of the wafer. This places considerable demands on the gimbal action of the wafer carrier.

In order to reduce the cost of ownership of a wafer carrier, it is desirable to avoid complicated gimbal actions having a relatively large number of cooperating parts, Especially mechanical parts which are subject to ongoing degradation due to wear and contamination.

SUMMARY OF THE INVENTION

It is an object of the present invention to provide a carrier which cooperates with a polishing table to polish semiconductor wafers.

Another object of the present invention is to provide a wafer carrier having a lowered gimbal height and which is free to move with 360 degree of freedom movement.

Another object of the present invention is to provide a wafer carrier which isolates applied loads using internal hydrostatic forces.

Yet another object of the present invention is to provide a wafer carrier of the above-described types providing improved temperature equalization and temperature compensation.

Another object of the present invention is to provide a semiconductor wafer carrier in which characteristic deflections of the carrier pressure plate are selectively alterable without requiring reconstruction of the carrier.

Yet another object of the present invention is to provide a wafer carrier which operates with a substantial portion of the wafer being polished, being moved beyond the edge of the polishing pad so as to accommodate direct observation end point procedures, for example.

These and other objects of the present invention which will become apparent from studying the appended description and drawings are provided in a carrier assembly for polishing semiconductor wafers, the carrier assembly comprising:

a pressure plate;

means for coupling said diaphragm to an operating shaft;

a hub member having an upper portion and a lower portion disposed within the recess;

a diaphragm disposed within the recess between said hub member and said pressure plate portion, said diaphragm having a central portion joined to the lower portion of the hub, an outer portion disposed immediately adjacent the wall portion in sealing engagement therewith, and an intermediate flexible portion connecting the center and outer portions of the diaphragm, the diaphragm further having a pair of opposed major faces including a first major surface disposed immediately adjacent and spaced apart from said pressure plate portion so as to form a gap therewith and an opposed second major surface;

a cap member joined to said wall portion and extending toward said hub member, said cap member having an inner edge located immediately adjacent and spaced from said hub member so as to interfere with said hub member when said hub member is angularly displaced with respect to said pressure plate portion; and said hub member and said diaphragm member cooperating to define an internal passageway communicating with the first major surface of said diaphragm for introduction of a pressurized fluid between said diaphragm and said pressure plate portion.

BRIEF DESCRIPTION OF THE DRAWINGS

FIG. 4 is an exploded perspective view of the carrier in simplified form;

FIG. 5 is a cross-sectional view similar to that of FIG. 3 but showing an alternative pressure plate design;

DETAILED DESCRIPTION OF THE PREFERRED EMBODIMENTS

Turning now to the drawings, and initially to FIGS. 1–4, a carrier arrangement is generally indicated at 10. As will be seen herein, carrier 10 is adapted to acquire, transport and selectively release wafers, such as semiconductor wafers, or other thin workpieces, on demand. Carrier 10 is also adapted for applying a downforce and backing support to a wafer undergoing a polishing operation, in which the wafer is pressed against a table (or less preferably, a linear belt) carrying a polish pad, for example.

Figure 1:
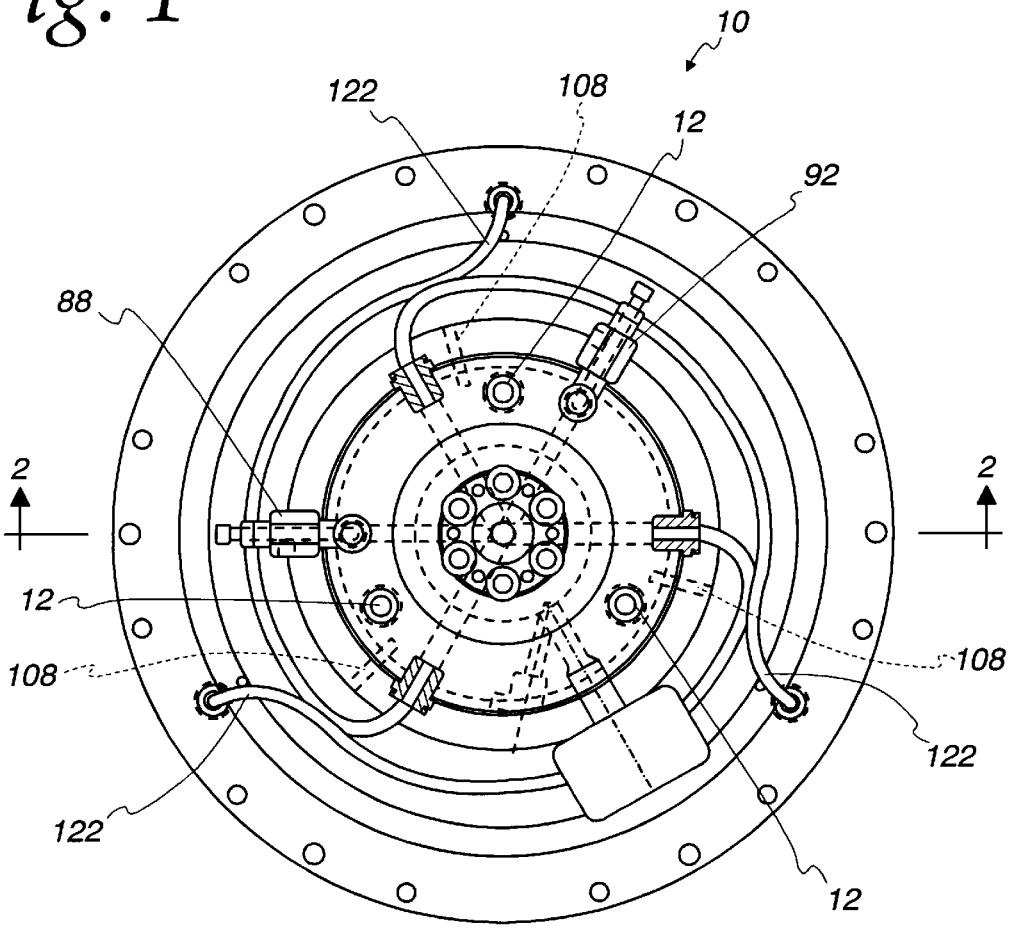
FIG. 1 is a top plan view of a carrier according to the principles of the present invention.
Figure 2:
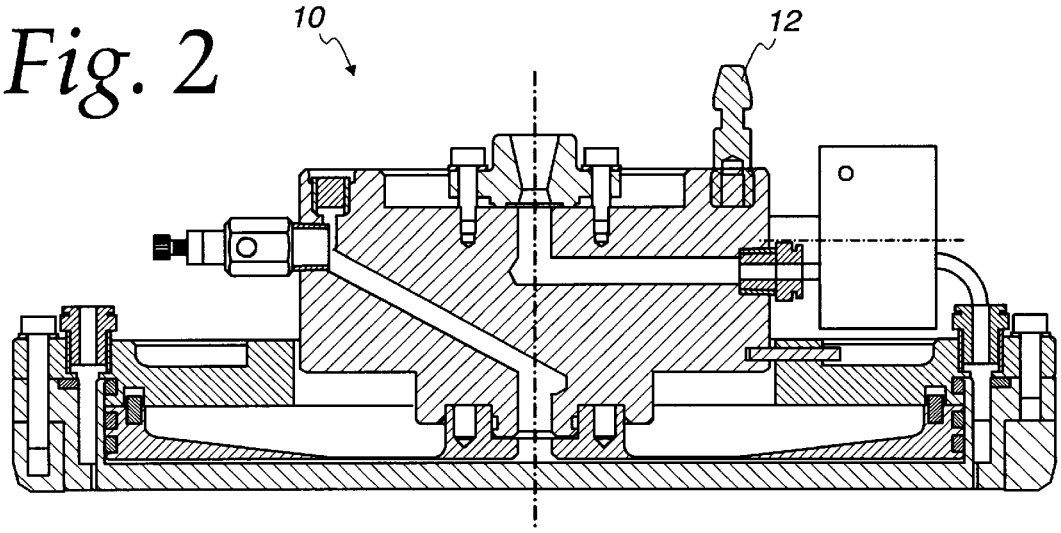
FIG. 2 is a cross-sectional view taken along the line 2—2 of FIG. 1.
Figure 3:
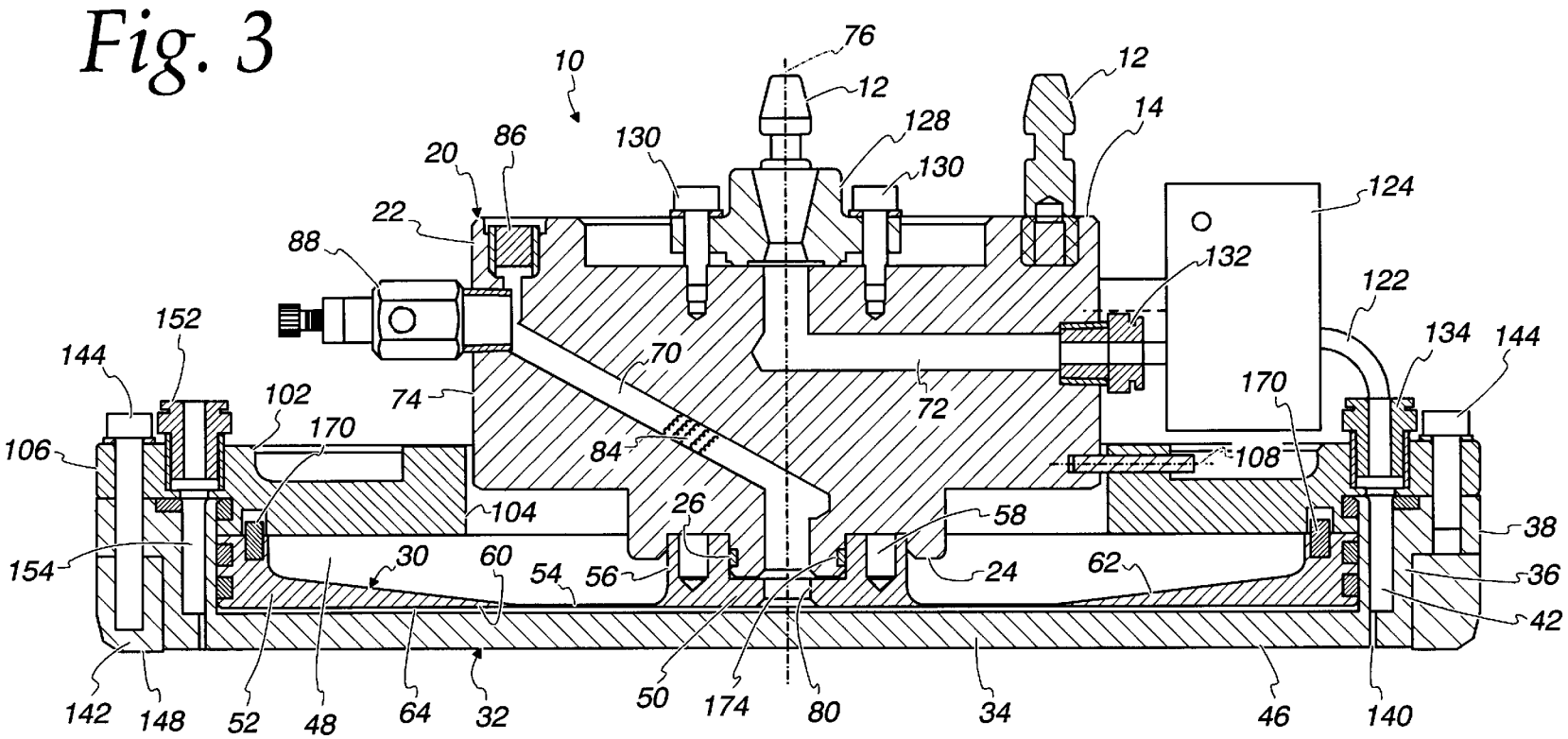
FIG. 3 shows the arrangement of FIG. 2 taken on an enlarged scale.

As can be seen, for example, in FIGS. 2 and 3, carrier 10 is comprised of a relatively small number of parts, the major sub-assemblies of which are indicated in schematic form in FIG. 4. Receiver 10 includes a bayonet mounting lug 12 (shown in FIGS. 2 and 3) adapted for quick connect joinder to a conventional spindle assembly. As is known in the art, the spindle applies a torsional force as well as a downforce to carrier 10 and hence to a semiconductor wafer or other workpiece (not shown) located at the bottom of the carrier. As can be seen in FIG. 1, several bayonet lugs 12 are provided to uniformly transmit forces to the upper end of the carrier assembly.

The bayonet lugs 12 are mounted in the upper end 14 of a hub assembly generally indicated at 20. The hub assembly 20 includes a monolithic one-piece hub member 22, preferably formed of stainless steel. The hub member may also be formed of a metal alloy or other rigid load-bearing material as may be desired. An opposed lower end 24 of the hub member defines stepped recesses 26 for coupling to a diaphragm member generally indicated at 30.

A body member generally indicated at 32 is preferably formed of one piece stainless steel material. Body member 32 could be formed in several cooperating parts, and could be fashioned from material other than metal, as desired. Body member 32 includes a pressure plate portion 34 joined at its outer periphery to a stepped wall portion 36 which terminates in a flange 38. As can be seen, for example, in FIG. 3, wall portion 36 defines a passageway 42 extending to the lower, exposed face 46 of pressure plate 34. As can be seen in FIG. 3, body member 32 is generally U-shaped in cross section, defining a concave recess or cavity 48 in which the diaphragm 30 is received.

Turning again to FIG. 3, diaphragm 30 preferably includes a central, raised stepped portion 50, an outer portion 52 of increasing thickness and an intermediate flexible portion 54 of substantial reduced thickness, chosen so as to render portion 54 relatively flexible with respect to its neighboring portions 50, 52. Preferably, diaphragm 30 is formed of stainless steel material, but could be formed of metal alloys, fiber reinforced composites or plastics material, if desired. The central portion 50 of diaphragm 30 includes stepped protrusions 56 received in the stepped lower end 24 of hub member 22. Threaded fasteners 58 join the central portion 50 of diaphragm 32 to the lower end 24 of hub member 22. It is noted that the optional interlocking connection of the stepped protrusions of diaphragm 30 and the stepped recesses of the hub member lower end cooperate to prevent lateral dislocation of the hub member with respect to the diaphragm member. If desired, however, the diaphragm can have virtually any thickness profile, including a constant thickness profile and a tapered profile, where the center and/or the outer periphery of the wafer have a reduced thickness.

Diaphragm member 30 has a lower major surface 60 which is preferably maintained substantially flat, and an opposed upper surface 62 which is open to the surrounding atmosphere. As can be seen in FIG. 3, a small gap 64 is formed between the lower surface 60 of diaphragm 30 and the opposed, upper surface of pressure plate portion 34. As will be seen herein, the gap 64 is maintained throughout carrier operation, separating diaphragm 30 from pressure plate portion 34 despite downforces and other forces applied to carrier 10 during a polishing or other surface treatment operation.

As can be seen in FIG. 3, hub member 22 defines first and second internal passageways 70, 72. Passageway 70 extends from a side wall 74 of hub member 22, adjacent its upper end 14, downwardly toward a center line of the carrier assembly 10, indicated by reference numeral 76. Passageway 70 then continues to the lower end 24 of hub member 22, communicating with a central opening 80 formed in central portion 50 in diaphragm 30, effectively extending passageway 70 to the gap 64 formed between diaphragm 30 and pressure plate portion 34. Passageway 70 is fully enclosed at its upper end by a bleed plug 86 and a conventional needle valve 88. As can be seen in FIG. 3, gap 64 is generally co-extensive with the pressure plate portion 34.

Carrier assembly 10 further comprises a pressurized fluid media 84 filling passageway 70 and extending to wall portion 36, filling gap 64. Fluid media 84 is introduced into passageway 70 by a second needle valve 92 (see FIG. 1) during a filling operation. The fluid media 84 is introduced under pressure, with the magnitude of the pressure being controlled by the setting of needle valve 88. In the preferred embodiment, the pressurized fluid media 84 comprises treated water, although other substantially incompressible liquids could be employed as well. The presence of relatively incompressible fluid media 84 in gap 64 prevents contact of diaphragm 30, especially the central portion 50 thereof, with the interior major surface of pressure plate 34. Less preferably, a compressible fluid media, such as air or other gas, can be used. It is desirable in this alternative that pressure be maintained at levels sufficient to maintain gap 64.

In a first embodiment of the present invention, the pressurized media 84 is sealed within passageway 70 and gap 64, being isolated from the ambient environment. The present invention thereby provides resistance to corrosion and contamination which has been found to affect other types of gimbal arrangements. Alternatively, in a second embodiment, an open fluid circuit (i.e., open with respect to carrier 10) is maintained in passageway 70 during the polishing operation, with needle valves 88, 92 being connected to an external fluid circuit (not shown). Whereas, in the first, preferred embodiment, the fluid media is maintained at a preselected pressure throughout the operational life of the carrier 10, the magnitude of the pressure of fluid media 84 can, in the second, open circuit embodiment, be varied as desired during a polishing operation. In either embodiment, there are no moving parts or bearings in the gimbal of the present invention to become corroded or contaminated.

The pressure plate portion 34 is illustrated in FIG. 3 as being essentially flat, with gap 64 being of uniform height throughout. However, the present invention contemplates optional pressure levels within the carrier assembly which slightly separate the central portion of diaphragm 30 from the central region of pressure plate portion 34, such that gap 64 is widened somewhat in the central portion of carrier assembly 10. The enlargement of gap 64 is associated with an outward bulging of pressure plate portion 34, or an upward deflection of central portion 50 of diaphragm 30, or both. Further, it is contemplated that, during a polishing operation, the downforce applied to the carrier assembly through bayonet lugs 12 and the upper portion of hub member 22 may also operate to enlarge gap 64 at the central portion of the carrier assembly.

Thus, the present invention provides an ability to tailor the contour of the pressure plate portion 34 with static pressure in gap 64 and passive influence from the load applied at the upper end of hub member 22. With the present invention, the characteristic deflection of pressure plate portion 34 can be altered by the closed-circuit hydrostatic preload (or alternatively, the open-circuit load) of the fluid media 84. For example, closed-circuit pressure was set in one embodiment to produce a pressure plate concavity of a few microns in 200 mm. Further, as will be appreciated by those skilled in the art, the present invention, which uses hydrostatic forces within the pressure plate assembly, provides an isolation of applied loads. The construction of carrier assembly 10 provides reduced vibrations and uniform carrier performance over the carrier life. Due to the presence of fluid media in gap 64 in immediate contact with pressure plate portion 34, a temperature equalization and compensation of the pressure plate portion is provided by the present invention, further contributing to improved polishing performance.

In addition to the above advantages, carrier assembly 10 provides an improved gimbal operation. As will be seen herein, gimbal operation of carrier assembly 10 is improved in that a complete 360 degree compliance of the gimbal is provided, as well as a low friction, free moving, non-degrading gimbal operation throughout the life of carrier assembly 10.

Referring again to FIG. 3, carrier assembly includes a cap member 102 having a central or internal stop face 101 and an outer flange portion 106. A pin member 108 is shown in the right-hand portion of FIG. 3, but is provided only for construction and set-up, and is removed prior to operation of the carrier assembly. Pin member 108 extends between the inner portion 104 of cap 102 and the outer wall 74 of hub member 22 to temporarily restrict movement of the hub member 22 with respect to the remainder of carrier assembly 10. As can be seen in FIG. 1, three pin members 108 are distributed about the carrier assembly.

With pins 108 removed, if the pressure level of fluid media within gap 64 is sufficiently great, hydrostatic pressures will be generated within carrier assembly 10 which cause an increased separation of hub member 22 from cap member 102. The central axis indicated by reference numeral 76 is shown in a rest position, with central axis 76 aligned in a vertical direction. As those skilled in the art will appreciate, during practical operation of carrier assembly 10, the central carrier axis 76 is likely to become slightly angularly offset from its rest position (typically, within a few degrees), due to forces applied to the carrier assembly. The response of the carrier assembly to such forces will now be considered.

As can be seen in FIG. 3, hub assembly 20 is rigidly mounted to the center of diaphragm 30 and the outer peripheral portion 52 of diaphragm 30 is rigidly secured to body member 32, such that forces tending to angularly shift the hub member away from reference axis 76 are efficiently coupled to the central portion 50 of diaphragm 30. Assuming that angular displacement of body member 32 is restrained by contact with a polish table, angular deflection forces will result in a flexure of flexible connecting portion 54 of diaphragm 30.

As will now be appreciated, the gimbal action of carrier assembly 10 occurs at the flexure of intermediate portion 54 of diaphragm 30, and the gimbal point is located at the intersection of central axis 76 and the lower surface 60 of diaphragm 30. In the preferred embodiment, carrier assembly 10 which is sized to accommodate a conventional 300 millimeter wafer, is limited to approximately 3 degrees of compliance, i.e., angular excursion of the hub member with respect to a rest position.

In one exemplar arrangement, pressure plate portion 34 has a thickness of 12 millimeters with gap 64 having a thickness of 3 millimeters. Thus, with the present invention the gimbal point is only 15 millimeters above the upper surface of the wafer being treated (assuming no backing film between the wafer and carrier is employed).

Since the gimbal action is associated with flexing of the plate-like diaphragm 30, cooperating inter-coupled mechanical gimbal components are eliminated, along with their inherent hysteresis and gradual degradation of performance over the life of the carrier assembly. Using conventional machining (or alternatively casting or molding) techniques, diaphragm 30 can be readily fabricated so as to exhibit an angularly uniform cross-section in the region of flexing portion 54. Accordingly, a complete 360 degree of freedom gimbal action which is reliable, unaffected by wear or other performance degradations, is provided in a cost efficient manner.

As will now be appreciated, the combination of plate-like or membrane-like diaphragm 30 and hydrostatic forces associated with relatively incompressible fluid in gap 64 combine to form a low friction gimbal action which is rigid in all other axes. Further, it will now be appreciated that gap 64 and passageway 70 form an isobaric pressure cavity which provides an even force distribution across the entirety of pressure plate portion 34 regardless of the gimbal loading (i.e., loading associated with flexing of diaphragm portion 54). Also, gimbal action in the present invention is not substantially influenced by downforce, even if flexure of the diaphragm should allow the diaphragm center to become raised.

These and other advantages afforded by carrier assembly 10 allow wafer polishing to continue when portions of the wafer extend beyond the periphery of the polish table. This latter type of operation is important to certain types of polishing procedures which regularly vary the relative positions of the internal and external diameters of workpieces with respect to a polish table. Also, so-called "off-table" polishing allows the use of certain end point determining mechanisms as well as specialized wafer rinse and lift-off procedures.

So-called "off-table" polishing operations also benefit from the wafer acquisition features incorporated in carrier assembly 10. For example, with reference to FIG. 3, wafer acquisition pressure signals are transmitted through the aforementioned passageway 72 formed in hub member 22. As shown in FIG. 3, a flexible tubing 122 connects passageway 72 with passageways formed in the flange portion of cap member 102 and the wall portion of body member 32, so as to cause the pressure signal to communicate with passageway 42 and ultimately to the lower, exposed face 46 of pressure plate portion 34. A signal control device 124 is associated with tubing 122 and may comprise, for example, a pressure indicating gauge used by an operator for pressure control, or may alternatively comprise a pressure regulator, for example.

Pressure signals associated with wafer acquisition and control are applied to a coupling member 128 which is secured to the upper end of hub member 22 by threaded fasteners 130. Stopper-like tubing connectors 132, 134 couple the flexible tubing 122 to passageways 72, 42. Pressure signals which enter coupling 128 emerge at a plurality of spaced openings 140 formed in the lower, exposed face 46 of pressure plate portion 34.

In normal operation, a wafer to be polished is placed against the exposed surface 46 of pressure plate portion 34, and extends beyond openings 140. If desired, a backing film is interposed between the wafer and exposed surface 46, but not in a manner which would obstruct the openings 140. Accordingly, pressure signals associated with wafer acquisition, vacuum transport and blowoff are applied to the outer wafer periphery at opening 140. In a wafer acquisition mode, carrier assembly 10 is placed over a wafer to be polished and a vacuum signal is applied at coupling 128, drawing the outer periphery of the wafer to the outer periphery of pressure plate 34. For certain ontable polishing operations, the vacuum signal can be lessened or discontinued during polishing, with the wafer being held between pressure plate portion 34 and a polish pad/polish table, as is known.

As illustrated in FIG. 3, wafer assembly 10 includes a conventional collar-like retainer ring 142 which is secured to outer wall 36 by threaded fasteners 144 extending through the flanges of cap 102 and body member 32, providing a convenient mode of assembling the major sub-components of carrier assembly 10. Retainer ring 142 has a lower end 148 which protrudes a slight distance beyond exposed major surface 46 of pressure plate portion 44. Retainer ring 142 confines lateral movement of the wafer being polished, thereby improving positional control of the wafer, even during "off-table" reciprocation of the carrier assembly as is a familiar practice in many conventional polishing operations.

Referring to the left-hand portion of FIG. 3, a third stopper-like coupler 152 is located in passageway 154 and performs in a manner similar to that described above with respect to passageway 42. As can be seen in FIG. 1, three pressure signals are applied to equally spaced points on the back surface of the wafer. Upon the completion of the polishing operation, carrier assembly 10, with vacuum signals applied at openings 140, is lifted and moved to a load cup or other wafer-receiving device. Vacuum signals applied to the series of openings 140 are then discontinued, allowing gravitational forces to act on the polished wafer. However, due to stiction associated with moisture on the back side of the polished wafer, it is desirable in certain instances to apply a positive pressure ("blowoff") signal to openings 140 to urge the wafer out of contact with the pressure plate surface, allowing the wafer to thereby be transferred to the load cup.

Turning now to FIG. 4, assembly of the carrier will be described. As is apparent from FIG. 4, the major sub-components of the carrier assembly are shown in simplified, schematic form. In a first step, the central portion of diaphragm 30 is secured at the lower end 24 of hub member 22. As can be seen, for example, in FIG. 3, inter-fitting protruding steps and recesses are drawn together by threaded fasteners 58. Thereafter, the diaphragm is lowered into the cavity 48 of body member 32. As shown, for example, in FIG. 3, a series of gaskets are located at the outer periphery of diaphragm 30 and dowel pins 170 provide alignment for the upper end of diaphragm 30. However, the outer periphery of diaphragm 30 may be bonded permanently or removably, to the inner surface of wall portion 36, in order to provide a pressure-tight seal and to preclude movement of the diaphragm away from the pressure plate portion 34. Similarly, the gasket members 174 between the diaphragm central portion and lower portion of hub member 22 may be replaced with a permanent or temporary bond to provide a pressure-tight seal, preventing escape of pressurized fluid media to the surrounding atmosphere.

Cap member 102 is fitted to the upper end of body member 32 and is sealed with gaskets surrounding the passageways 42, 154. Retaining ring 142 is then fitted to the opposed side of the wall portion and threaded fasteners 144 secure the cap, body member and retainer rings together. The flexible tubing members 122 are then installed to complete the wafer acquisition control circuits. Thereafter, the needle valves 88, 92 are installed and pressurized fluid is pumped into passageway 70 so as to enter the gap 64.

Figure 6:
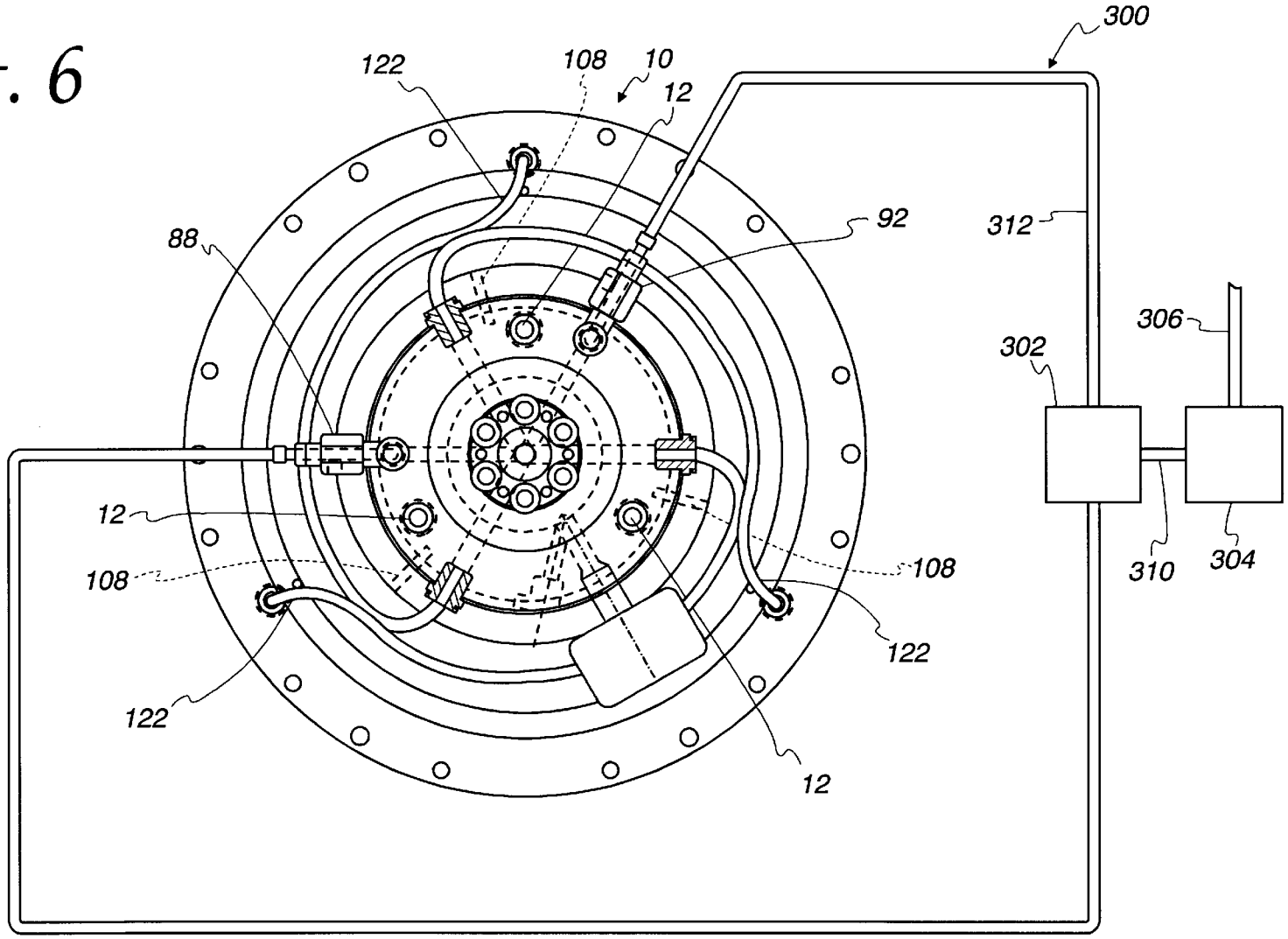
FIG. 6 is a top plan view of a carrier and control arrangement.

In the closed circuit embodiment, pressure from passageway 70 and gap 64 is then increased to the desired level and the fluid passageways are permanently sealed off for the life of the carrier assembly. Alternatively, if an open circuit operation (i.e., open with respect to the carrier) is desired, the needle valves 88, 92 are coupled to an external fluid pressure source, preferably one in which fluid pressure can be controlled on an ongoing basis. For example, with reference to FIG. 6, wafer carrier 10 is coupled to an external control arrangement generally indicated at 300. In the control arrangement, needle valves 88, 92 are coupled to a pressure regulator 302 which operates in response to signals from a microcomputer based controller 304 having an input 306. For real-time ongoing control of pressure plate cross-sectional shape, computer input 306 is coupled to an in-situ conventional metrology apparatus. The metrology apparatus measures wafer parameters, such as wafer surface contour or wafer thickness, for example. Output data from the metrology apparatus is fed through input 306 to computer controller 304. An output signal responsive to the metrology data is output on line 310 which is fed into pressure regulator 302 changing the pressure in line 312, and hence in the gap 64 within carrier 10. The pressure signal within the carrier would then alter the flexure or shape of pressure plate portion 34. For example, if the metrology apparatus should indicate a "center slow" polishing condition in which the polishing rate at the center of the wafer is falling behind the polishing rate at the wafer exterior, a corresponding signal would be developed by computer controller 304 and fed into pressure regulator 302 to increase the pressure in gap 64, causing the center of pressure plate 34 to exhibit a greater concave curvature, thereby increasing polishing pressure to the center of the wafer being polished. Conversely, if the center of the wafer is being polished too quickly as indicated by data on input 306, computer 304 would direct the pressure regulator 302 to reduce internal pressure within the carrier, and within gap 64 resulting in the pressure plate 34 assuming a less convex, i.e., flatter shape, thereby reducing the polishing rate at the center of the wafer.

Control arrangement 300 could also be employed in an ex-situ arrangement in which a polishing process is interrupted or allowed to conclude, with the wafer being transported by carrier 10 to a remote metrology station. Data from the remote metrology station would then be fed into input 306 in the manner described, so as to change internal pressure within the carrier for subsequent polishing actions in order to provide a "batch correction" for wafers subsequently polished.

With either option, the pressure levels in the hydrostatic circuit of passageway 70 and gap 64 can be set to produce a desired shape to the pressure plate portion 34. For example, as mentioned, pressures can be limited so as to avoid a bulging, which would take the pressure plate portion out of a flat condition. Alternatively, the pressure levels can be established so as to impart a desired convex shape to the outer surface 46 of the pressure plate portion 34.

Figure 7:
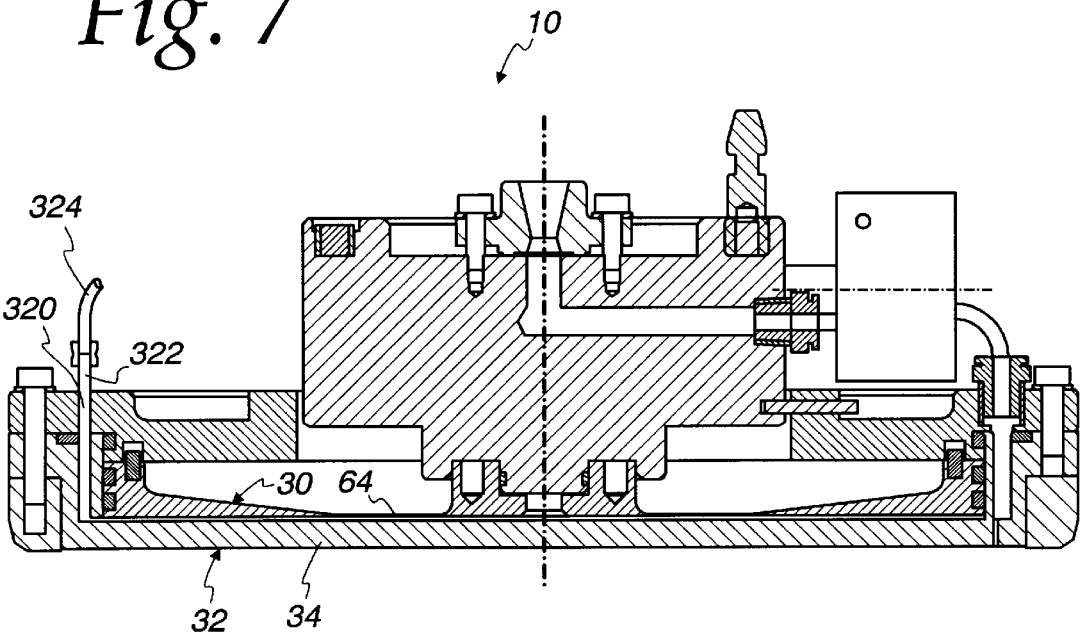
FIG. 7 is a cross-sectional view showing an alternative internal pressure cavity arrangement.

Turning now to FIG. 7, carrier assembly 10 is provided with a passageway 320 extending through body member 32 to gap 64, without passing through diaphragm 30. As with the preceding embodiments, virtually any suitable pneumatic or hydraulic connection means can be provided for passageway 320. As shown, both rigid tubing 322 and flexible tubing 324 are employed to couple pressure signals to gap 64. If desired, either enclosed (i.e., closed circuit) or open circuit connections can be made to the passageway 320, as described above. As can be seen in FIG. 7, the central passageway through the diaphragm and hub have been omitted.

Figure 8:
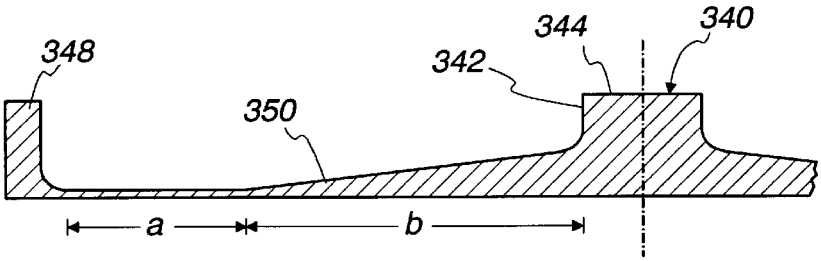
FIG. 8 is a fragmentary cross-sectional view of an alternative diaphragm member.

Referring now to FIG. 8, an alternative diaphragm member is generally indicated at 340. As with the preceding embodiments, diaphragm member 340 is preferably comprised of stainless steel or other metal alloy material, but could also be made from composite and plastics constructions, if desired. Diaphragm 340 has a central portion 342 of increased thickness and includes an upper surface 344 for connection to an external source of polishing pressure. Diaphragm 340 has an outer peripheral portion 348 of increased thickness and an intermediate portion 350 which is continuously curved at its upper surface and which has a gradually increasing thickness as the center of the diaphragm is approached. Two regions are indicated in FIG. 8. The first region a is relatively thin, so as to readily flex in the desired pressure operating range. The radially interior adjoining portion indicated by the reference character b is tapered to produce an iso-stress condition. In operation, flexure is mostly localized to section a, while section b behaves in a more rigid manner. The diaphragm 340 is preferably comprised of a single monolithic form, but could be comprised of several portions joined together.

If desired, the pressure plate could be formed to have a concave depression facing the wafer. With suitable application of internal pressure in gap 64, the pressure plate concavity can be reduced, or the pressure plate can be made to have a flat or convex bottom surface profile.

Further alternatives, constructions and operations of the carrier assembly are possible with the present invention. The material, shape and rigidity of the pressure plate portion 34 can be modified, for example. Turning now to FIG. 5, a carrier assembly 10 is shown incorporating an alternative pressure plate portion 250 which has reduced cross-sectional thickness adjacent its outer periphery, as can be seen in FIG. 5.

If desired, the pressure plate portion 250 can be selectively weakened in other, conventional ways. For example, a series of slots, holes or other recesses can be formed in the back or upper side of the pressure plate portion, thus increasing the tendency of the pressure plate to bow or deflect under operation of internal pressure in the hydrostatic circuitry associated with passageway 70 and gap 64.

As a further alternative, it may be desired to control hydrostatic pressure within the carrier assembly using hydraulic or pneumatic control signals. If desired, the conventional pneumatically operated piston could be inserted in passageway 70 so as to apply a desired level of pressure to fluid media 84.

If desired, fluid pressure within carrier 10 could be maintained at a desired negative (i.e. vacuum) level. It is preferable in such arrangements that the gap 64 be increased or the stiffness of the diaphragm be increased, or other conventional measures taken to prevent the closing of gap 64 when elevated negative pressure levels are called for.

In another alternative arrangement, coil spring or pneumatic spring elements can be inserted between cap 102 and the rear surface of diaphragm 62 in order to control the response of the diaphragm to applied internal hydrostatic pressure loads, and applied downforce loads during a polishing operation. However, this has not been found to be necessary.

As mentioned above, the stop surfaces 104 of cap 102 interfere with side wall 74 of hub member 22, in order to limit the amount of angular excursion of the hub member away from its rest position. As can be seen in FIG. 3, stop surface 104 is spaced from hub side wall 74, the spacing being directly related to angular excursion of the hub member. If desired, the stop face 104 of cap 102 or side wall 74 of hub member 22 can carry threaded fastener or collar members in order to selectively adjust the gap spacing as may be desired. Alternatively, ring-like shims of varying thickness can be associated with stop surface 104 or side surface 74 in order to change the gap spacing which controls angular deviation of hub member 22. Further, resilient buffers such as coil springs or pneumatic springs can be installed in contact surface 104 or side surface 74 to provide increasing resistance to angular mediation of hub member 22, before the hub member is rigidly stopped from further excursion.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A carrier assembly for polishing semiconductor wafers, the carrier assembly comprising:

a body member having an outer wall portion and a pressure plate portion, cooperating to form a concave recess;

a hub member having an upper portion and a lower portion disposed within the recess;

a diaphragm disposed within the recess between said hub member and said pressure plate portion, said diaphragm having a central portion joined to the lower portion of the hub, an outer portion disposed immediately adjacent the wall portion in sealing engagement therewith, and an intermediate flexible portion connecting the center and outer portions of the diaphragm, the diaphragm further having a pair of opposed major faces including a first major surface disposed immediately adjacent and spaced apart from said pressure plate portion so as to form a gap therewith and an opposed second major surface; and said hub member and said diaphragm member cooperating to define an internal passageway communicating with the first major surface of said diaphragm for introduction of a pressurized fluid between said diaphragm and said pressure plate portion.

2. The carrier of claim 1 further comprising a fluid pressure media within said passageway and between said diaphragm and said pressure plate portion.

3. The carrier of claim 1 further comprising a cap member joined to said wall portion and extending toward said hub member, said cap member having an inner edge located immediately adjacent and spaced from said hub member so as to interfere with said hub member when said hub member is angularly displaced with respect to said pressure plate portion.

4. The carrier of claim 2 further comprising passageway sealing means cooperating with said hub member to enclose said fluid pressurized media.

5. The carrier of claim 2 wherein said fluid pressurized media comprises a substantially incompressible fluid.

6. The carrier of claim 5 wherein said fluid pressurized media comprises an aqueous fluid.

7. The carrier of claim 1 wherein said diaphragm defines a central opening communicating with said passageway and extending to the first major surface of said diaphragm.

8. The carrier of claim 7 wherein said hub includes an outer side wall extending between said upper and said lower hub portions, and said first passageway defined in said hub extends from said outer wall toward said lower portion.

9. The carrier according to claim 1 wherein said pressure plate portion is of substantially constant thickness.

10. The carrier of claim 1 wherein said cap member contacts the outer portion of said hub member so as to prevent movement of the diaphragm away from said pressure plate portion.

11. The carrier of claim 1 wherein the outer portion of said diaphragm is joined to the wall portion of said body member in sealing engagement therewith.

12. The carrier of claim 1 wherein said diaphragm has a cross-sectional thickness, and said central portion and said outer portions have a greater thickness than the thickness of said flexible portion.

13. The carrier of claim 12 wherein said first major surface of said diaphragm member is essentially flat and said second major surface is outwardly and either upwardly or downwardly tapered away from said central diaphragm portion.

14. The carrier of claim 3 wherein said pressure plate portion includes an exposed major face opposing the wafer being polished and said wall portion defines a wafer securement passageway extending to the pressure plate exposed face, said carrier further comprising signal connection means for connection to an external pressure force for applying positive and negative pressure signals to the exposed pressure plate face to release and engage said wafer being polished.

15. The carrier according to claim 14 wherein said cap member defines a cap passageway communicating with said wafer securement passageway.

16. The carrier of claim 15 wherein said hub further defines a second passageway for carrying said pressure signals to said exposed face of said pressure plate.

17. The carrier according to claim 16 wherein said second passageway defined by said hub extends from the upper portion of the hub.

18. The carrier of claim 17 further comprising a flexible coupling tube connecting said second passageway formed in said hub to said passageway formed in said cap member so as to carry pressure signals to the exposed face of said pressure plate portion.

19. The carrier of claim 18 further comprising pressure gauge means associated with said flexible tubing to indicate the pressure of the signal being applied to said pressure plate exposed surface.

20. The carrier according to claim 1 wherein said pressure plate portion has a central part and an outer part adjacent the wall portion, said pressure plate portion having a greater thickness at its center portion and a reduced thickness at its outer portion.

21. The carrier according to claim 1 wherein the lower portion of said hub member and the center portion of said diaphragm form cooperating stepped recesses and protrusions so as to provide support against lateral dislocations of said hub member with respect to said diaphragm.

22. The carrier of claim 3 further comprising a retainer ring joined to said wall portion so as to protrude beyond said pressure plate exposed face.

23. The carrier of claim 22 wherein said cap member and said wall portion include overlying flange parts arranged in a series with said retainer ring, said carrier further comprising elongated fasteners extending through said cap member, said wall portion and said retainer ring for joining the cap member, said wall portion and said retainer ring together.

24. A carrier assembly for polishing semiconductor wafers, the carrier assembly comprising:

a body member having an outer wall portion and a pressure plate portion, cooperating to form a concave recess;

a hub member having an upper portion and a lower portion disposed within the recess;

a diaphragm disposed within the recess between said hub member and said pressure plate portion, said diaphragm having a central portion joined to the lower portion of the hub, an outer portion disposed immediately adjacent the wall portion in sealing engagement therewith, and an intermediate flexible portion connecting the center and outer portions of the diaphragm, the diaphragm further having a pair of opposed major faces including a first major surface disposed immediately adjacent and spaced apart from said pressure plate portion so as to form a gap therewith and an opposed second major surface;

said hub member and said diaphragm member cooperating to define an internal passageway communicating with the first major surface of said diaphragm for introduction of a pressurized fluid between said diaphragm and said pressure plate portion;

a fluid pressure media within said passageway and between said diaphragm and said pressure plate portion; and passageway sealing means cooperating with said hub member to enclose said fluid pressurized media.

25. The carrier of claim 24 further comprising a cap member joined to said wall portion and extending toward said hub member, said cap member having an inner edge located immediately adjacent and spaced from said hub member so as to interfere with said hub member when said hub member is angularly displaced with respect to said pressure plate portion.

26. The carrier of claim 24 wherein said fluid pressurized media comprises a substantially incompressible liquid.

27. The carrier of claim 26 wherein said fluid pressurized media comprises an aqueous solution.

28. A carrier assembly for polishing semiconductor wafers, the carrier assembly comprising:

a diaphragm having a central portion, an outer portion, and an intermediate flexible portion connecting the center and outer portions of the diaphragm;

a pressure plate spaced from said diaphragm and cooperating with said diaphragm to form a pressure cavity therewith;

means for introducing a pressurized fluid in said pressure cavity; and coupling means for coupling said diaphragm to a source of polishing pressure, said polishing pressure being transmitted through said diaphragm, said pressurized fluid and said pressure plate to said wafer.

29. The carrier of claim 28 further comprising a fluid pressure media within said pressure cavity.

30. The carrier of claim 29 wherein said fluid pressurized media comprises a substantially incompressible liquid.

31. The carrier of claim 30 wherein said fluid pressurized media comprises an aqueous solution.

32. The carrier of claim 28 wherein said means for introducing a pressurized fluid in said pressure cavity comprises a passageway extending through said diaphragm.

33. The carrier of claim 28 wherein said pressure plate is spaced from said diaphragm to form a gap therewith, said pressure plate and said diaphragm being generally coextensive with one another with adjacent outer edges, said carrier further comprising a body member with a wall portion enclosing the outer edges of said pressure plate and said diaphragm to form said pressure cavity.

* * * * *